US007567268B2

(12) United States Patent
Akamatsu

(10) Patent No.: US 7,567,268 B2
(45) Date of Patent: Jul. 28, 2009

(54) IMAGE FORMING APPARATUS AND ABNORMALITY DETECTING METHOD

(75) Inventor: Hidenori Akamatsu, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 191 days.

(21) Appl. No.: 11/504,617

(22) Filed: Aug. 16, 2006

(65) Prior Publication Data

US 2007/0047086 A1 Mar. 1, 2007

(30) Foreign Application Priority Data

Aug. 23, 2005 (JP) ..... 2005-241660

(51) Int. Cl.
*B41J 2/47* (2006.01)
*B41J 2/435* (2006.01)

(52) U.S. Cl. ..... 347/235; 347/250

(58) Field of Classification Search ..... 347/229, 347/234–237, 246–250; 372/29.02, 26; 399/384; 359/204

See application file for complete search history.

(56) References Cited

U.S. PATENT DOCUMENTS 4,837,787 A * 6/1989 Takesue et al. ..... 372/29.02
4,862,288 A * 8/1989 Sekiya ..... 347/254
4,963,941 A * 10/1990 Negishi et al. ..... 399/384
5,864,355 A * 1/1999 Bush et al. ..... 347/235
6,795,458 B2 * 9/2004 Murata ..... 372/26
7,167,268 B2 * 1/2007 Mori ..... 359/204
2001/0028388 A1 * 10/2001 Makino ..... 347/235

FOREIGN PATENT DOCUMENTS

JP 5-236226 9/1993
JP 10-44502 2/1998
JP 10239605 A * 9/1998
JP 2001-205848 7/2001
JP 2002326387 A * 11/2002

* cited by examiner

*Primary Examiner*—Hai C Pham
(74) *Attorney, Agent, or Firm*—Oblon, Spivak, McClelland, Maier & Neustadt, P.C.

(57) ABSTRACT

A light-emission control unit controls an emission of a light beam from a light-beam generating unit based on an input image signal. A light-beam scanning unit deflects the light beam in a main scanning direction and irradiates the deflected light beam on an image carrier. An anomalous-light emission detecting unit detects an anomalous light emission of the light-beam generating unit when there is no image signal input to the light-emission control unit. A control unit performs an error processing based on the detected anomalous light emission.

18 Claims, 15 Drawing Sheets

IMAGE FORMING APPARATUS AND ABNORMALITY DETECTING METHOD

CROSS-REFERENCE TO RELATED APPLICATIONS

The present document incorporates by reference the entire contents of Japanese priority document, 2005-241660 filed in Japan on Aug. 23, 2005.

BACKGROUND OF THE INVENTION

1. Field of the Invention

The present invention relates to an image forming apparatus including a light-beam generating unit such as a laser diode, and more particularly, to an image forming apparatus and an abnormality detecting method for detecting anomalous light emission of the light-beam generating unit to perform error processing.

2. Description of the Related Art

An image forming apparatus including a light-beam generating unit has an optical writing device or an optical scanning device including a light-beam generating unit, a light-emission control unit that drives the light-beam generating unit with a driving signal modulated by an image signal input to cause the light-beam generating unit to emit light, a light deflector (a polygon mirror) that deflects and reflects a light beam modulated by an image signal, and an image carrier (a photosensitive drum, etc.) on which a latent image is written according to scanning of the light beam deflected by the light deflector. As the light-beam generating unit, in general, a laser light source such as a laser diode is used. In a color image forming apparatus, for example, color image signals of four colors of yellow (Y), magenta (M), cyan (C), and black (K) modulate light beams, respectively, to form images of Y, M, C, and K on four image carriers. Latent images written on the image carriers are developed by toners, transferred onto a transfer member such as recording paper, and superimposed one on top of another to form a color image.

A driving-current/laser-beam-output characteristic of the laser diode is described. FIG. 16 is a graph of the driving-current/laser-beam-output characteristic of the laser diode. As the driving-current/laser-beam-output characteristic of the laser diode, as shown in FIG. 16, an optical output is weak until a forward current reaches a fixed threshold current Ith and suddenly increases when the forward current exceeds the threshold current Ith. In the image forming apparatus, an electric current obtained by adding an electric current Idr (=light emission current Iη+offset amount) corresponding to an image signal to a bias current Ibi, which is obtained by adding the offset amount to or subtracting the offset amount from the threshold current Ith, is applied to the laser diode as a driving current Iop. The laser diode is driven with the bias current Ibi when an image signal is not input. The laser diode is driven with the driving current Iop=Ibi+Iη+offset amount when an image signal is input. It is possible to drive the laser diode at high speed by always feeding a bias current in this way. Whether the bias current Ibi is set larger than the threshold current Ith depends on a design idea of an image forming engine, in particular, a photosensitive member. When the bias current Ibi is set larger than the threshold current Ith, a rising characteristic of the laser diode is improved. When the bias current Ibi is set smaller than the threshold current Ith, it is possible to prevent scumming while maintaining a certain degree of rising characteristic. In FIG. 16, the bias current Ibi is set smaller than the threshold current Ith.

This driving-current/laser-beam-output characteristic has temperature dependency. As temperature rises, the threshold current Ith tends to increase. An image forming apparatus that includes a bias-current setting unit to make it possible to compensate for the temperature dependency of the threshold current Ith is disclosed in, for example, Japanese Patent Application Laid-Open No. H5-236226. The bias-current setting unit gradually increases the bias current Ibi applied to a laser diode at the time of image formation, detects a laser beam output to generate a monitor signal, and sets the bias current Ibi at the time of image formation based on a bias current value at the time when a level of the monitor signal is higher than a predetermined level.

However, in the image forming apparatus disclosed in Japanese Patent Application Laid-Open No. H5-236226, when the bias-current setting unit malfunctions because of an influence of noise or the like at the time of setting of the bias current Ibi and the bias current Ibi is set excessively larger than the threshold current Ith shown in FIG. 16, the laser diode emits light even when an image signal is not input to the laser diode. Therefore, an abnormal image such as an image with lateral lines or an entirely solid image is formed in an area without an image. As a result, an image carrier suffers light-induced fatigue and a toner is wasted to impose a burden on a user and adversely affect the image forming apparatus.

SUMMARY OF THE INVENTION

It is an object of the present invention to at least partially solve the problems in the conventional technology.

An image forming apparatus according to one aspect of the present invention includes a light-beam generating unit that emits a light beam; a light-emission control unit that controls an emission of the light-beam generating unit based on an input image signal; a light-beam scanning unit that deflects the light-beam emitted from the light-beam generating unit in a main scanning direction and irradiates the deflected light beam on an image carrier; a developing unit that develops a latent image formed by the light beam on the image carrier to produce a visible image; a transferring unit that transfers the visible image to a transfer member; an anomolous-light emission detecting unit that detects an anomolous light emission of the light-beam generating unit when there is no image signal input to the light-emission control unit; and a control unit that performs an error processing based on the detected anomolous light emission.

An abnormality detecting method according to another aspect of the present invention includes emitting including a light-beam generating unit emitting a light beam; controlling including a light-emission control unit controlling an emission of the light beam of the light-beam generating unit based on an input image signal; scanning including a light-beam scanning unit deflecting the light beam emitted from the light-beam generating unit in a main scanning direction and irradiating the deflected light beam on an image carrier; developing including a developing unit developing a latent image formed by the light beam on the image carrier to produce a visible image; transferring including a transferring unit transferring the visible image to a transfer member; detecting including an anomalous-light emission detecting unit detecting an anomalous light emission of the light-beam generating unit when there is no image signal input to the light-emission control unit; and controlling including a control unit performing an error processing based on the detected anomalous light emission.

An image forming apparatus according to still another aspect of the present invention includes a light-beam generating means for emitting a light beam; a light-emission control means for controlling an emission of the light beam of the light-beam generating means based on an input image signal; a light-beam scanning means for deflecting the light beam emitted from the light-beam generating means in a main scanning direction and irradiating the deflected light beam on an image carrier; a developing means for developing a latent image formed by the light beam on the image carrier to produce a visible image; a transferring means for transferring the visible image to a transfer member; an anomalous-light emission detecting means for detecting an anomalous light emission of the light-beam generating means when there is no image signal input to the light-emission control means; and a control means for performing an error processing based on the detected anomalous light emission.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

Figure 1:
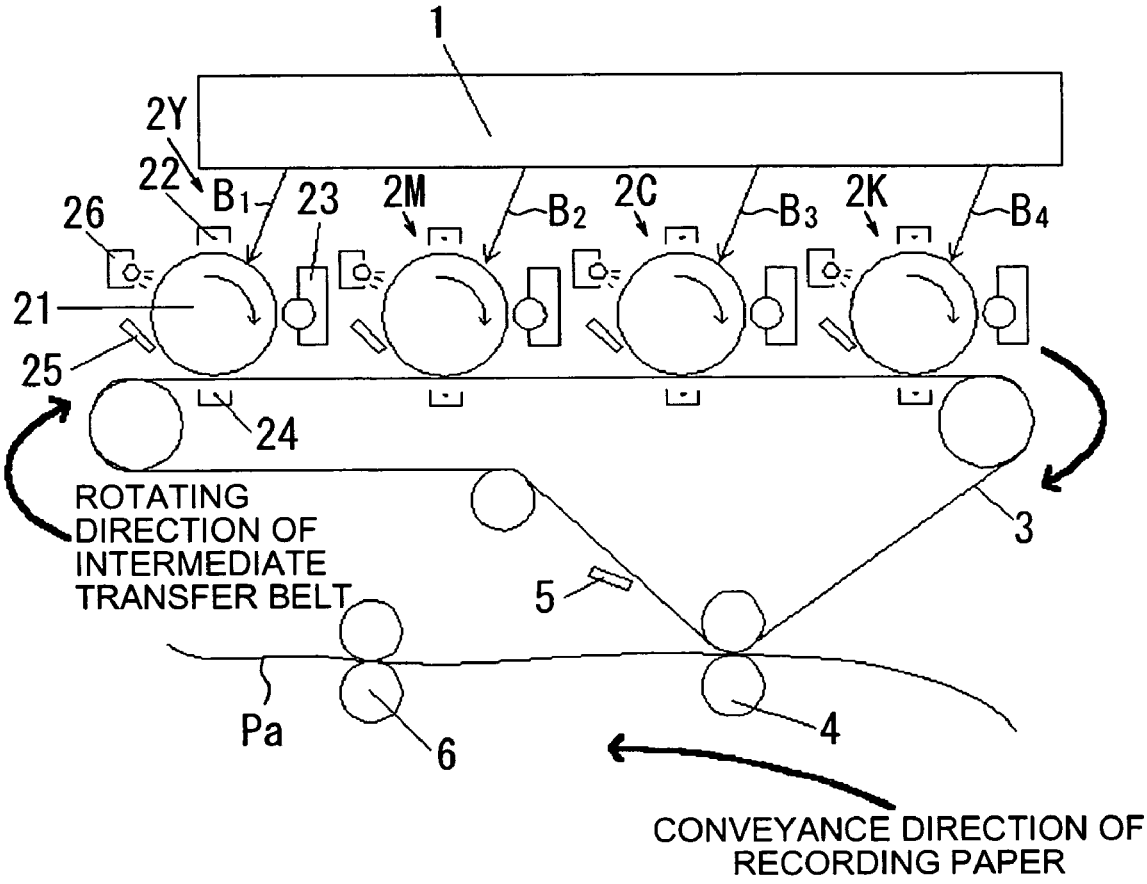
FIG. 1 is a diagram of a schematic structure of an image forming unit of an image forming apparatus according to a first embodiment of the present invention.

FIG. 1 is a diagram of a schematic structure of an image forming unit of an image forming apparatus according to a first embodiment of the present invention. The image forming apparatus is a tandem full-color machine and includes a writing unit 1, intermediate image forming units 2Y, 2M, 2C, and 2K, an intermediate transfer belt 3, a secondary transfer device 4, a cleaning device 5, and a fixing device 6.

The intermediate image forming units 2Y, 2M, 2C, and 2K receive irradiation of four light beams B1 to B4 from the writing unit 1 and form images of four colors, Y, M, C, and K. The images of Y, M, C, and K formed by the intermediate image forming units 2Y, 2M, 2C, and 2K are superimposed one on top of another on the intermediate transfer belt 3 to form a full color image. The secondary transfer device 4 transfers (secondarily transfers) the full color image on the intermediate transfer belt 3 to recording paper Pa. The cleaning device 5 cleans the intermediate transfer belt 3 after the secondary transfer. The fixing device 6 fixes the full color image transferred on the recording paper Pa.

The intermediate image forming units 2Y, 2M, 2C, and 2K are arranged along a conveyance direction of the intermediate transfer belt 3 such that the images of Y, M, C, and K are superimposed one on top of another on the intermediate transfer belt 3. The four colors are arranged in an order of Y, M, C, and K. However, the arrangement of the colors is not limited to this. Various orders like Y, C, M, and K are possible.

The writing unit 1 includes a laser diode (hereinafter, "LD") as a light source that emits a light beam. It is also possible to use an LD array, a vertical-cavity surface-emitting laser (VCSEL), a light emitting diode (LED), or electroluminescence (EL) instead of the LD. Each of the intermediate image forming units 2Y, 2M, 2C, and 2K includes a photosensitive member (a drum or a belt) 21 serving as an image carrier, a charging device 22 that charges the photosensitive member 21, a developing device 23 that visualizes a latent image written by a light beam from the writing unit 1, a primary transfer device 24 that transfers a visible image developed by the developing device 23 onto the intermediate transfer belt 3, a cleaning device 25 that cleans the visible image remaining on the photosensitive member 21, and a charge eliminating device 26 that eliminates charges of the photosensitive member 21.

When image formation is performed, the respective intermediate image forming units 2Y, 2M, 2C, and 2K and the intermediate transfer belt 3 rotate clockwise in FIG. 1 and the recording paper Pa is conveyed from the right to the left in FIG. 1. First, a light beam B1 is irradiated on the intermediate image forming unit 2Y from the writing unit 1 and the image of Y is developed and transferred onto the intermediate transfer belt 3. Then, a light beam B2 is irradiated on the intermediate image forming unit 2M from the writing unit 1 and the image of M is developed and transferred to be superimposed on the image of Y on the intermediate transfer belt 3. Subsequently, the image of C and the image of K are transferred to be superimposed one after another. Consequently, a full color image is formed on the intermediate transfer belt 3. This full color image is transferred onto the recording paper Pa by the secondary transfer device 4 and fixed by the fixing device 6. As a result, the full color image is formed on the recording paper Pa.

Figure 2:
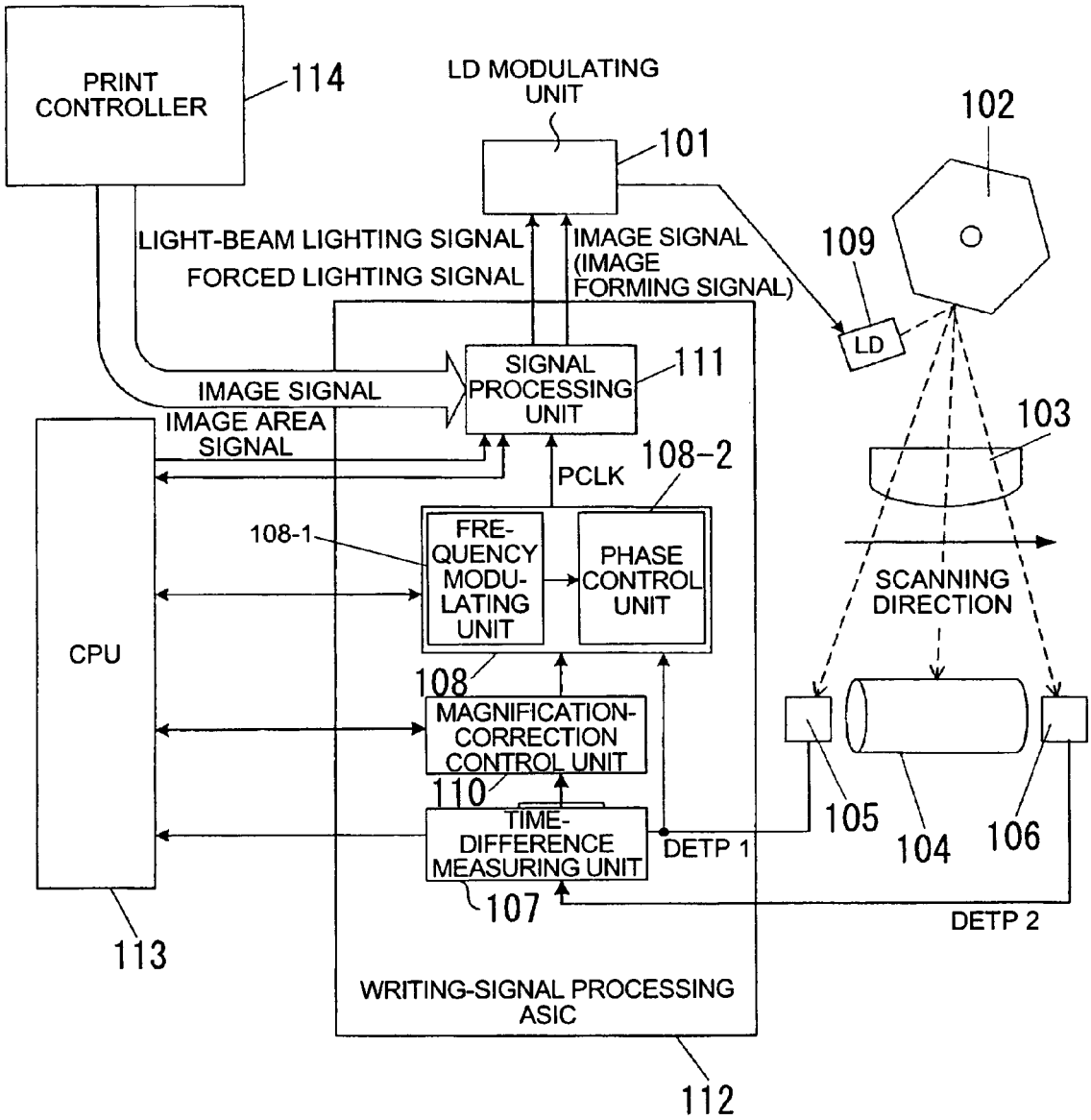
FIG. 2 is a block diagram showing a structure of a writing unit.

FIG. 2 is a block diagram of a structure of a writing unit. A central processing unit 113 and a print controller 114 are common to four colors of Y, M, C, and K. Structures of other components are the same for the four colors. Thus, the respective components are denoted by reference numerals without Y, M, C, and K affixed thereto.

The writing unit includes a laser diode (LD) 109, a polygon mirror 102, an fθ lens 103, and a not-shown barrel toroidal lens (BTL).

The LD 109 is modulated by an image signal to be turned on. The polygon mirror 102 deflects a light beam, which is emitted from the LD 109, changed to parallel beams by a not-shown collimate lens, and converged by a not-shown cylinder lens, in a main scanning direction at uniform angular velocity. The fθ lens 103 performs uniform angular velocity and uniform linear velocity conversion of the light beam deflected by the polygon mirror 102.

The light beam, which has passed through the fθ lens 103 and the BTL, is irradiated on a photosensitive member 104 serving as an image carrier. The polygon mirror 102 is driven to rotate by a polygon motor (not shown). A drum-like photosensitive member or a belt-like photosensitive member is used as the photosensitive member 104. The BTL mainly performs focusing in a sub-scanning direction (a condensing function and positional correction in the sub-scanning direction (surface toppling, etc.)). The charging device 22, the developing device 23, the primary transfer device 24, the cleaning device 25, the charge eliminating device 26, and the like shown in FIG. 1 are arranged around the photosensitive member 104. An image is formed on the recording paper Pa serving as a transfer member according to a usual electrophotographic process.

Optical sensors 105 and 106 are provided at a front end and a rear end in the main scanning direction of the light beam of the writing unit. The light beam, which has transmitted through the fθ lens 103, is made incident on the optical sensor 105 and 106 and detected. The optical sensor 105 is a synchronous detection sensor for generating a leading-end synchronous detection signal corresponding to start timing of one line of main scanning. A position where the optical sensor 105 is arranged is a forced light emission position for detection of scanning start timing. The optical sensor 106 is a synchronous detection sensor for generating a back-end synchronous detection signal corresponding to end timing of the one line of the main scanning. A position where the optical sensor 106 is arranged is a forced light emission position for detection of scanning end timing. In FIG. 2, only the fθ lens 103 is shown as a representative of a plurality of lenses provided.

Moreover, this writing unit includes a writing-signal processing ASIC 112 that is input with an image signal from the print controller 114, exchanges various data and commands with the CPU (control device) 113, executes various kinds of processing described later and an LD modulating unit 101 that drives the LD 109 to emit light according to an image signal or the like outputted from the writing-signal processing ASIC 112.

The writing-signal processing ASIC 112 mainly includes a time-difference measuring unit 107, a magnification-correction control unit 110, a writing-clock generating unit 108, and a signal processing unit 111.

The time-difference measuring unit 107 measures a time difference between time when a leading-end synchronous detection signal DETP1, which is generated when the optical sensor 105 detects a light beam, is detected and time when a back-end synchronous detection signal DETP2, which is generated when the optical sensor 106 detects a light beam, is detected. The time-difference measuring unit 107 calculates an average value of the time difference and the like.

The time difference measuring unit 107 performs the measurement of a time difference and the calculation of an average value according to setting timing from the CPU 113 and sends results of the measurement and the calculation to the writing-clock generating unit 108.

The magnification-correction control unit 110 has a storing unit that stores a writing clock frequency set by the CPU 113 and an initial setting value and a present setting value of a phase adjustment value. The magnification-correction control unit 110 calculates an optimum writing clock frequency and an optimum phase adjustment value corresponding to a measurement result and a calculation result of the time-difference measuring unit 107. Alternatively, the magnification-correction control unit 110 fixes a writing clock frequency and calculates an optimum phase adjustment value corresponding to a measurement result and a calculation result of the time-difference measuring unit 107. Further, the magnification-correction control unit 110 compares the phase adjustment value and a reference value set by the CPU 113 and sends a control signal for carrying out writing clock setting and phase adjustment to the writing-clock generating unit 108 according to setting of the CPU 113.

The writing-clock generating unit 108 executes generation of a writing clock and phase adjustment in response to a control signal from the magnification-correction control unit 110. The writing-clock generating unit 108 includes a frequency modulating unit 108-1 and a phase control unit 108-2.

The frequency modulating unit 108-1 generates a clock of a frequency n times as high as a writing clock (pixel clock) PCLK in response to supply of a clock from a not-shown oscillator.

The phase control unit 108-2 divides a PLL oscillation clock by n in synchronization with the leading-end synchronous detection signal DETP1 serving as a synchronous detection signal and generates the writing clock PCLK synchronizing with the leading-end synchronous detection signal DETP1. The phase control unit 108-2 has a function of adding an amount integer times as large as a half period of the PLL oscillation clock to a specific period of the writing clock or subtracting the amount from the specific period to shift a writing clock period by a unit of one pixel.

The signal processing unit 111 supplies an image signal (an image forming signal) synchronizing with the writing clock PCLK to the LD modulating unit 101 based on an image signal sent from the print controller 114 and the writing clock PCLK supplied from the writing clock generating unit 108 and subjected to frequency-variable and phase-variable image magnification correction of the main scanning. In addition, the signal processing unit 111 supplies a light-beam lighting signal and a forced lighting signal to the LD modulating unit 101 based on an image area signal or the like from the CPU 113.

A reason for performing magnification correction is as described below. In the image forming apparatus shown in FIGS. 1 and 2, when, in particular, a plastic lens is used as the fθ lens, since linear expansion coefficient of plastic is relatively large, beam spot deviation due to changes in a shape and an index of refraction of the plastic lens caused by a change in environmental temperature, a change in temperature in the apparatus is innegligible. When an index of refraction changes in each beam because of a change, fluctuation, or the like in a wavelength of a laser beam and beam spot deviation due to the change in an index of refraction is innegligible, a scanning position on an image surface of an image carrier changes to cause a magnification error in the main scanning direction. As a result, a high quality image cannot be obtained. This problem is solved by changing a frequency and a phase of a clock for writing pixels constituting an image signal according to a time difference between the leading-end synchronous detection signal and the back-end synchronous detection signal and correcting a scanning magnification of each laser beam.

Figure 3:
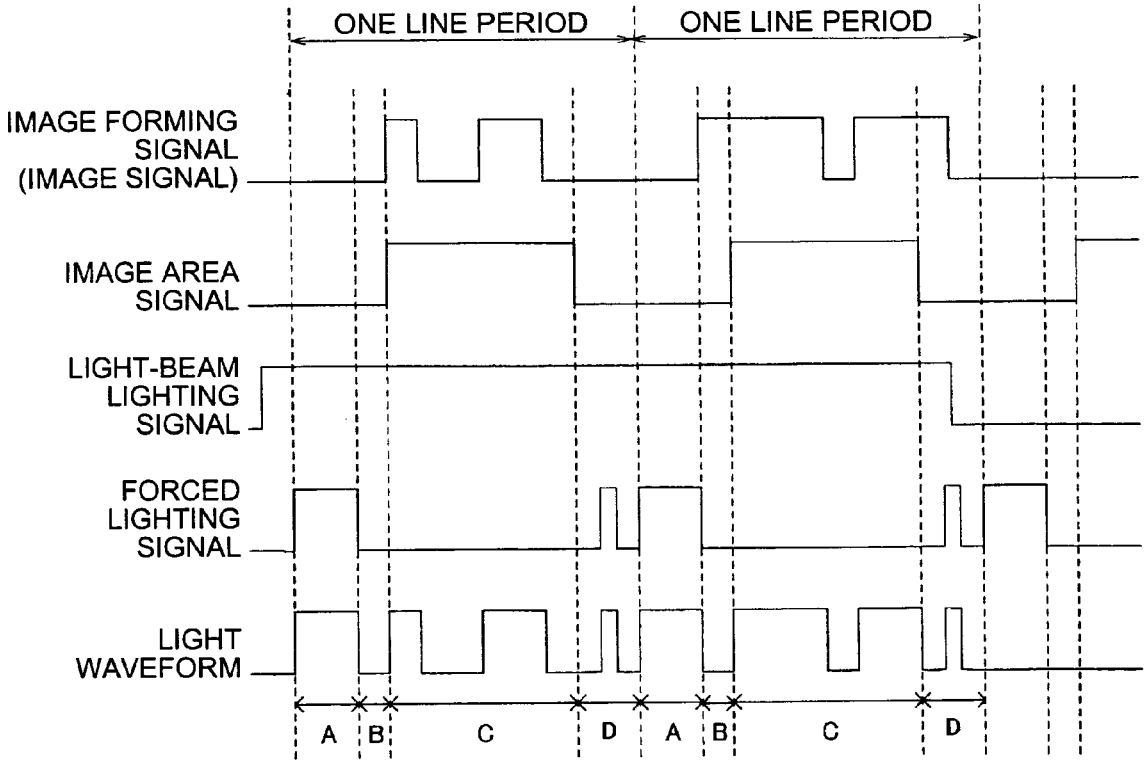
FIG. 3 is a timing chart of a timing relation between various signals input to and outputted from a signal processing unit and a driving signal (a light waveform) supplied from a laser diode (LD) modulating device to an LD.

FIG. 3 is a timing chart of a timing relation between various signals input to and outputted from the signal processing unit 111 and a driving signal (a light waveform) supplied from the LD modulating unit 101 to the LD 109.

A light-beam lighting signal shown in FIG. 3 is a control signal for activating the LD modulating unit 101. The LD modulating unit 101 outputs a driving signal (a light waveform) to the LD 109 only in a period in which the control signal is at a high level.

In FIG. 3, an image area signal is a signal indicating a range of an effective image forming area in one line scanning period. The image area signal is outputted from the signal processing unit 111 to the LD modulating unit 101. When the image area signal is active (at a high level), the image area signal indicates that a period is an effective image forming area. In a scanning optical system using the polygon mirror 102, about 60% of one line scanning period is an effective image forming area.

An image forming signal (an image signal) is a signal for instructing image formation. The image forming signal is outputted from the signal processing unit 111 to the LD modulating unit 101. When the image forming signal is active (at a high level), the image forming signal indicates that image formation is performed.

As shown in FIG. 3, the image area signal is at the high level in a period C and the period C is an effective image forming area. The image forming signal is active (at the high level) in the period C.

A forced lighting signal shown in FIG. 3 is outputted from the signal processing unit 111 to the LD modulating unit 101. The forced lighting signal is a control signal for causing the LD modulating unit 101 to output a driving signal (a light waveform) to the LD 109. When a high-level forced lighting signal is input to the LD modulating unit 101 from the signal processing unit 111, the LD modulating unit 101 applies setting of an indication that forced light emission is performed to the LD 109. Consequently, the LD 109 forcibly outputs a driving signal and emits light. On the other hand, when a low-level forced lighting signal is input to the LD modulating unit 101 from the signal processing unit 111, the LD modulating unit 101 applies setting of an indication that forced light emission is not performed to the LD 109. Consequently, the LD 109 does not output a driving signal forcibly and does not emit light.

The LD modulating unit 101 applies a driving current Iop, which is obtained by adding an electric current Idr (=light emission current Iη+offset amount) corresponding to a level of the image forming signal to a bias current Ibi of the LD 109 set at the time of initial setting, to the LD 109. Therefore, in the period C, a light beam scanning device turns on or turns off light according to the level of the image forming signal to form a latent image on the photosensitive member 104. The bias current Ibi is set to be equal to or smaller than a threshold current Ith. This is because, if the bias current Ibi is set larger than the threshold current Ith, the LD 109 emits light even when the image forming signal is not input thereto (anomalous light emission).

In a non-image forming area other than the effective image forming area, the forced lighting signal is activated in a period A before the effective image forming area and a part of a period D after the effective image forming area to cause the LD 109 to emit light. The period A is a forced lighting period in which the optical sensor 105 detects a light beam. The part of the period D is a forced lighting period in which the optical sensor 106 detects a light beam. An output of the optical sensor 105 is used as a start timing signal for the main scanning as described above. It is also possible to use the output of the optical sensor 105 to perform auto power control for adjusting a level of a light waveform such that the output of the optical sensor 105 in the image forming area is at a predetermined reference level.

Figure 4:
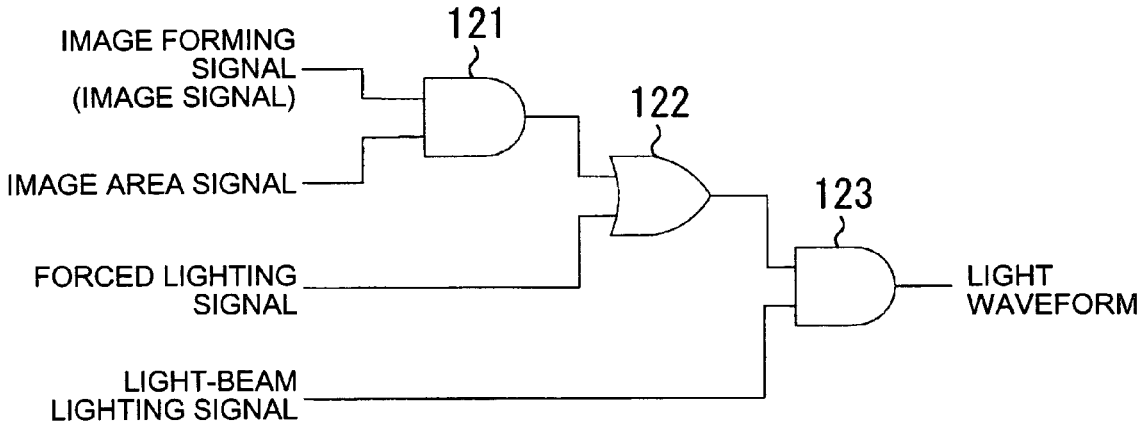
FIG. 4 is a diagram of a logical circuit that generates a light waveform from various input signals in the LD modulating unit.

FIG. 4 is a circuit diagram of a logical circuit that generates a driving signal (a light waveform) from various input signals in the LD modulating unit 101. The logical circuit shown in FIG. 4 includes an AND circuit 121 that is input with an image forming signal (an image signal) and an image area signal, an OR circuit 122 that is input with an output of the AND circuit 121 and a forced lighting signal, and an AND circuit 123 that is input with an output of the OR circuit 122 and a light-beam lighting signal and outputs a light waveform. Therefore, when the light-beam lighting signal is at the high level (on) and the forced lighting signal is at the high level, the driving signal (the light waveform) is outputted regardless of a level of the image forming signal.

Figure 5:
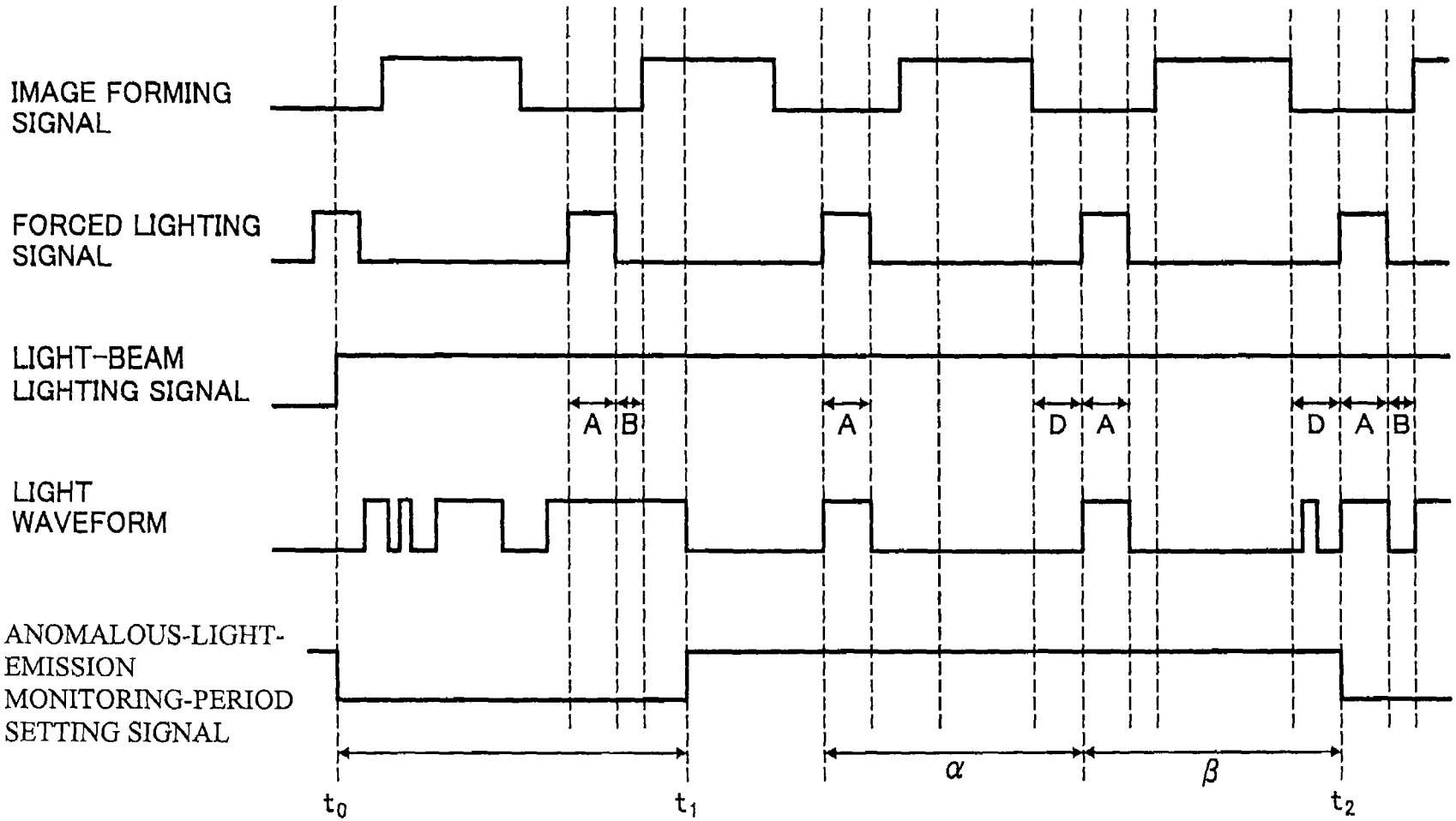
FIG. 5 is a timing chart of a timing relation between various signals and a driving signal (a light waveform) in respective periods of an initialization operation and an anomalous light emission monitoring operation.

The writing unit executes an initialization operation for performing, for example, setting of a threshold current immediately after turning on the LD 109. Thereafter, the writing unit executes an anomalous light emission monitoring operation and, then, executes a normal operation. FIG. 5 is a timing chart of a timing relation between various signals and a driving signal (a light waveform) in respective periods of the initialization operation and the anomalous light emission monitoring operation.

In FIG. 5, an anomalous light emission-monitoring-period setting signal is a control signal for setting a period for performing the anomalous light emission monitoring operation. In a period in which the anomalous light emission-monitoring-period setting signal is at a high level, the anomalous light emission monitoring operation is executed. In a period in which the anomalous light emission-monitoring-period setting signal is at a low level, the anomalous light emission monitoring operation is not executed. In FIG. 5, an image forming signal, a forced lighting signal, a light-beam lighting signal, and a light waveform (a driving signal) are the same as those explained with reference to FIG. 3.

In FIG. 5, a period from time to $t_0$ time $t_1$ (about 1 millisecond) is a section in which the initialization operation is executed. A period from time $t_1$ to time $t_2$ is a section in which the anomalous light emission monitoring operation is executed. In the initialization operation, turn-on and turn-off of the LD 109 are repeated regardless of whether an area is an effective image forming area or a non-image forming area. Therefore, to prevent a detection output of the optical sensor 106 during the initialization operation from being judged as anomalous light emission, as shown in FIG. 5, at the time of the initialization operation executed from time $t_0$ to time $t_1$, the anomalous light emission-monitoring-period setting signal is set to a low level to prevent a monitoring operation for anomalous light emission from being executed.

ON the other hand, as shown in FIG. 5, in the period from time $t_1$ to time $t_2$, to execute the anomalous light emission monitoring operation, the anomalous light emission-monitoring-period setting signal is set to a high level. A period A in the anomalous light emission monitoring period from $t_1$ to $t_2$ is a forced lighting period in which the optical sensor 105 detects a light beam. The forced lighting signal is set to on (a high level) to perform forced light emission of the LD 109. When optical sensors 105 and 106 detect a light beam in such a forced lighting period, detection signals of the optical sensors 105 and 106 are outputted to the time-difference measuring unit 107 as detection signals of scanning timing. On the other hand, in a period D in the anomalous light emission monitoring period, the forced lighting signal is set to off (a low level) not to perform forced light emission of the LD 109 to prevent the optical sensor 106 from detecting a light beam. When the optical sensor 106 detects a light beam in this period, a detection signal of the optical sensor 106 is treated as a detection signal of anomalous light emission. Therefore, as indicated by an a period in FIG. 5, when the optical sensor 106 does not detect a light beam in the period D in the anomalous light emission monitoring period, anomalous light emission is not performed and it is judged that light emission is normal. On the other hand, as indicated by a β period in FIG. 5, when the optical sensor 106 detects a light beam in the period D in the anomalous light emission monitoring period, the light beam is detected despite the fact that the period D is a section in which the optical sensor 106 does not detect a light beam because the forced lighting signal is off. Thus, there is anomalous light emission from the LD 109 and it is judged that an error has occurred.

Figure 6:
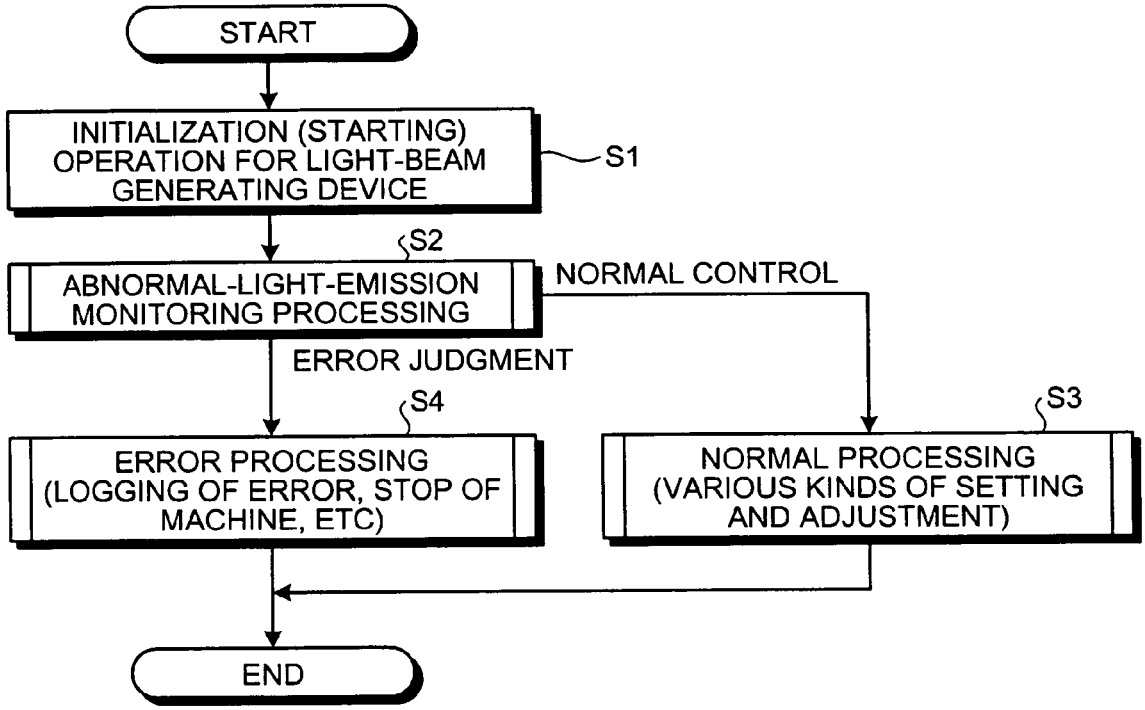
FIG. 6 is a flowchart of a flow from an initialization operation to error processing or normal processing through anomalous light emission monitoring.
Figure 7:
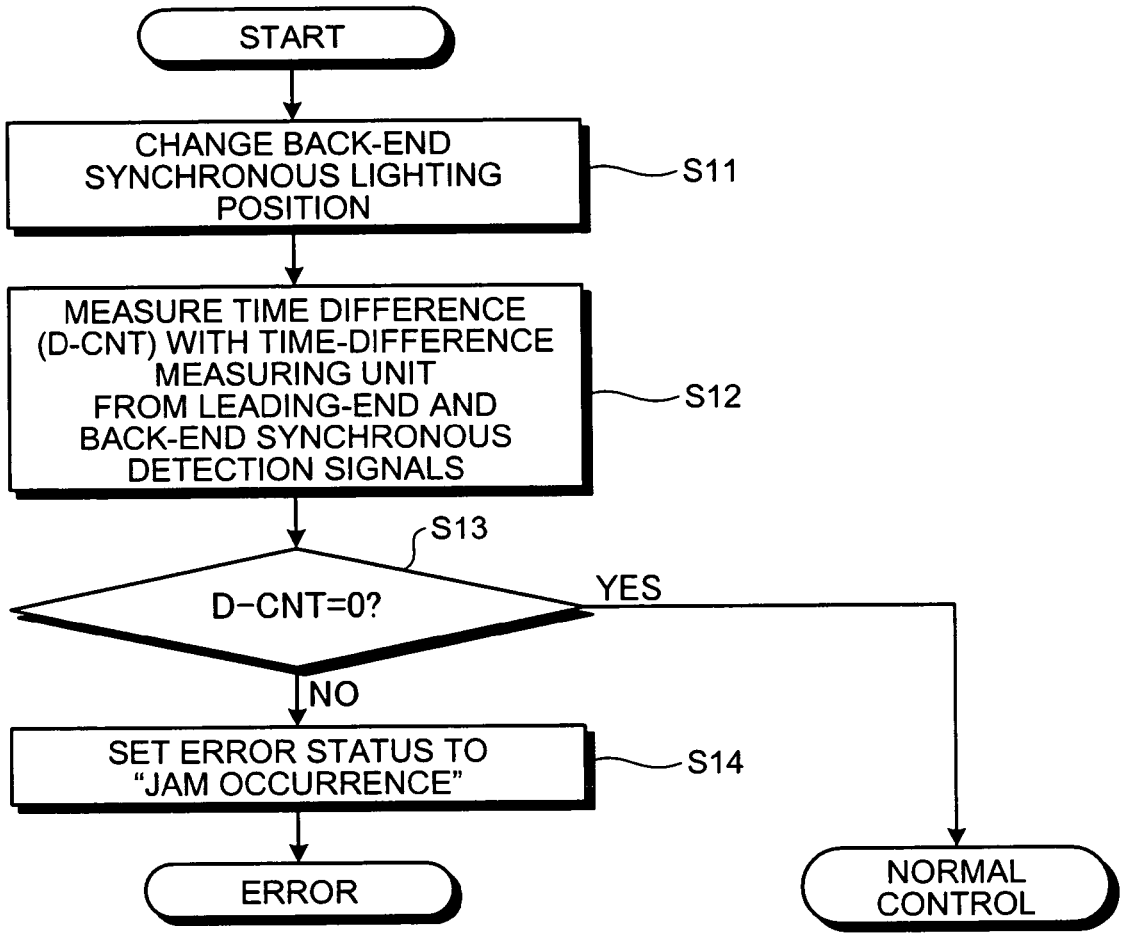
FIG. 7 is a flowchart of a flow of anomalous-light-emission monitoring processing.
Figure 8:
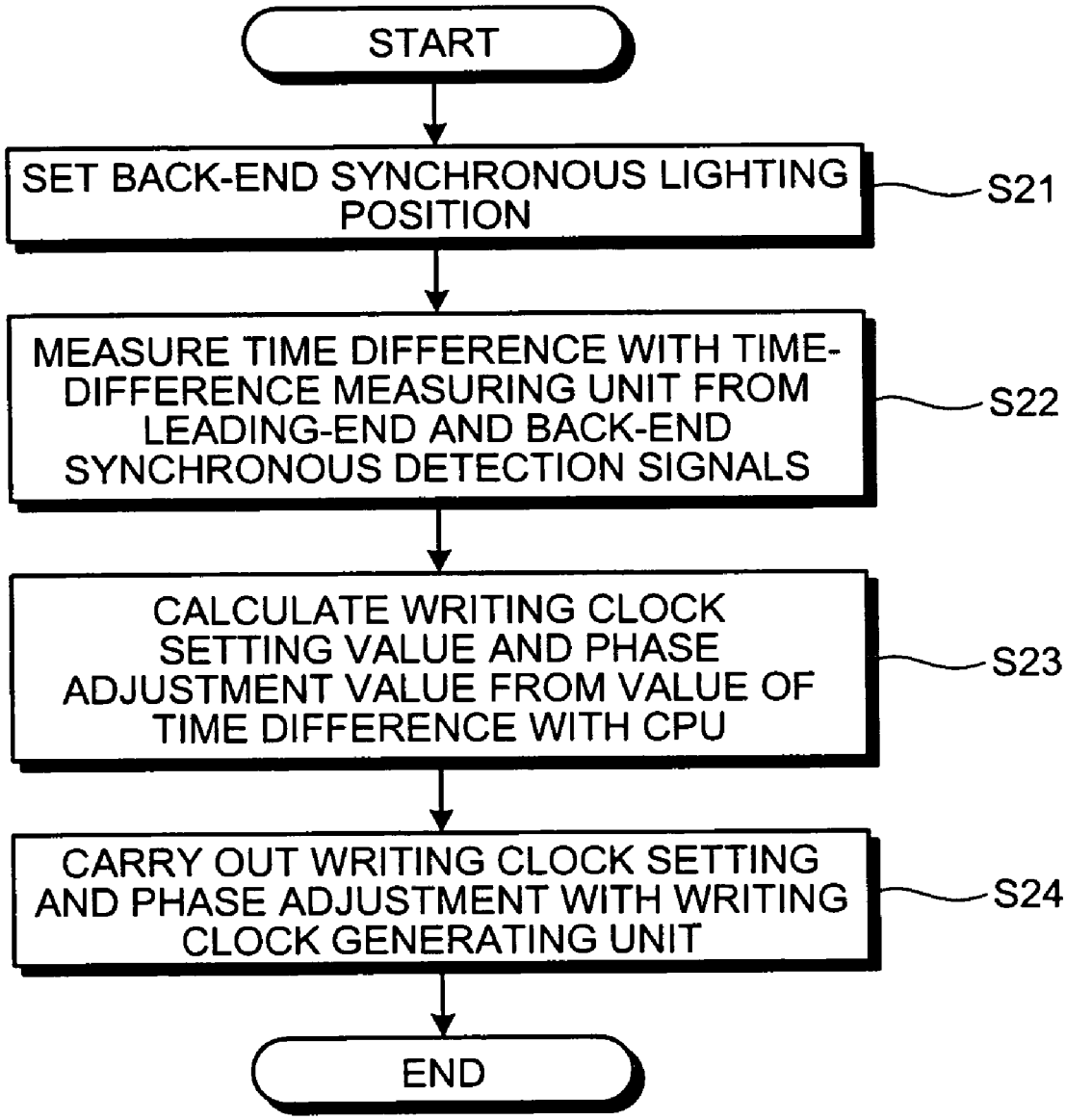
FIG. 8 is a flowchart of a flow of phase adjustment processing for a writing clock PCLK, which is an example of the normal processing.
Figure 9:
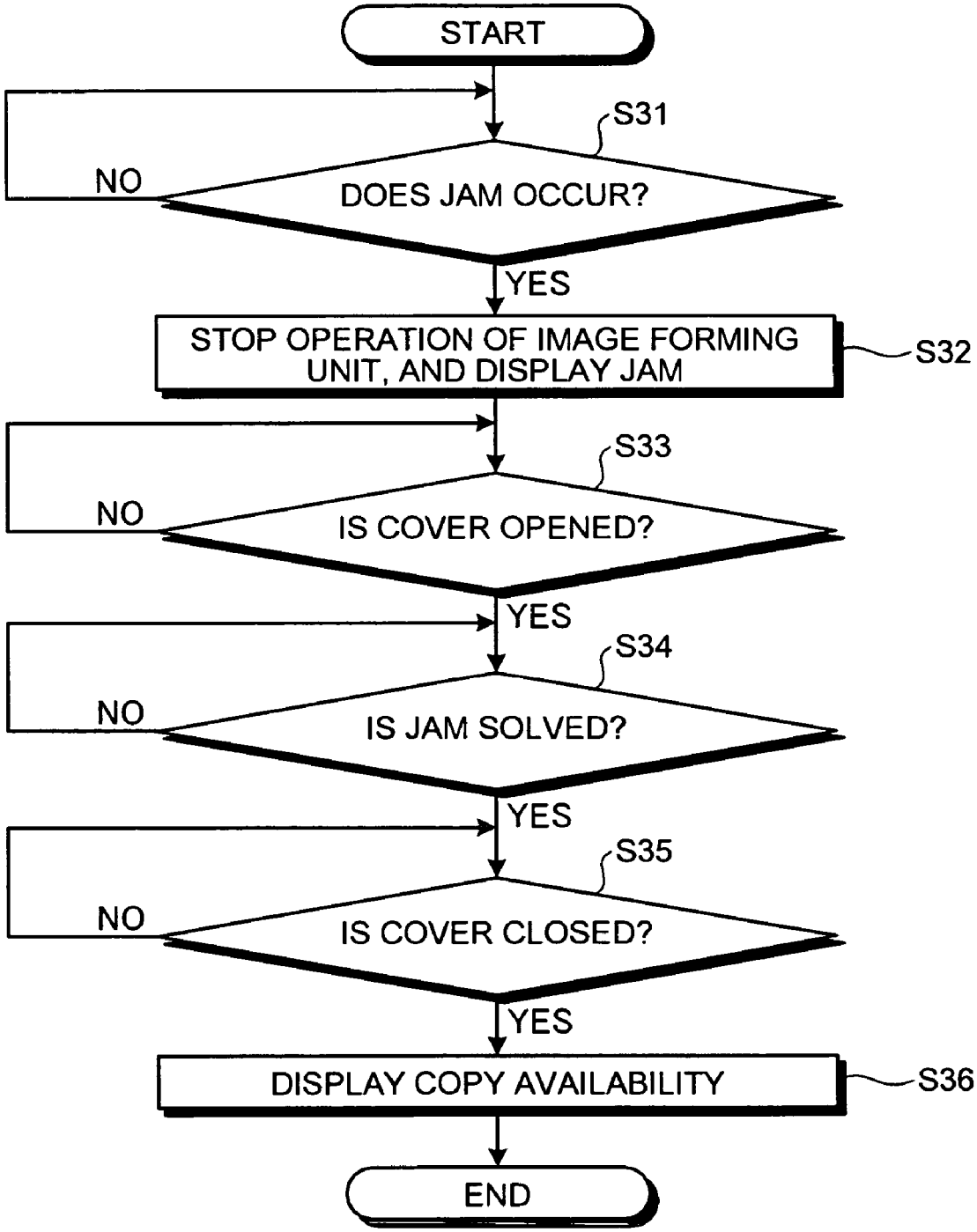
FIG. 9 is a flowchart of a flow of error processing.

Operations of the writing unit having the structure described above are explained with reference to flowcharts in FIGS. 6 to 9. FIG. 6 is a flowchart of a flow from an initialization operation to error processing or normal processing through anomalous light emission monitoring. FIG. 7 is a flowchart of a flow of anomalous-light-emission monitoring processing. FIG. 8 is a flowchart of a flow of phase adjustment processing of a writing clock PCLK, which is an example of the normal processing. FIG. 9 is a flowchart of a flow of the error processing.

First, as shown in FIG. 6, the CPU 113 performs an initialization operation for the writing unit (step S1). In this initialization operation, in the period from time $t_0$ to time $t_1$ explained with reference to FIG. 5, the CPU 113 repeats turn-on and turn-off of the LD 109 with a light waveform applied from the LD modulating unit 101 to the LD 109. In addition, the CPU 113 gradually increases an amplitude of the light waveform, generates a monitor signal of a light emission level with a photodiode (not shown) in a case identical with that of the LD 109, and sets a threshold current based on a bias current value at the time when a level of the monitor signal is higher than a predetermined level.

Subsequently, the CPU 113 executes the anomalous-light-emission monitoring processing shown in FIG. 7 (step S2). Referring to FIG. 7, in the period D shown in FIG. 5 corresponding to the period D shown in FIG. 3, the CPU 113 changes a back-end synchronous lighting position by setting a forced lighting signal off not to perform forced light emission of the LD 109 (step S11). The time-difference measuring unit 107 measures a time difference (D-CNT) of detection time between a leading-end synchronous detection signal of the optical sensor 105 and a back-end synchronous detection signal of the optical sensor 106 (step S12). The CPU 113 judges whether the time difference measured is 0 (step S13). When the time difference measured is not 0 ("No" at step S13), the CPU 113 judges that an error has occurred and sets an error status to "jam occurrence" (step S14). Consequently, when anomalous light emission is detected, jam stop processing described later is executed. In this jam stop processing, a light emission operation of the LD 109 is reset. Then, back in FIG. 6, the CPU 113 performs error processing (logging of the error, stop of the machine, etc.) (step S4). On the other hand, when the difference measured is 0 ("Yes" at step S13), the CPU 113 judges that light emission is normal. Then, back in FIG. 6, the CPU 113 performs normal processing (various kinds of setting and adjustment) (step S3).

When the LD 109 abnormally emits light, the LD 109 emits light in the period D in which the LD 109 does not originally emit light. Thus, a measurement value of the time-difference measuring unit 107 takes a positive value equivalent to a difference between time when the optical sensor 105 detects a light beam and time when the optical sensor 106 detects a light beam. When the LD does not abnormally emit light, after the optical sensor 105 detects a light beam, a time difference is not measured and the measurement value of the time-difference measuring unit 107 is reset to 0 at start time of the period A after one line. Therefore, at step S13, the CPU 113 judges presence or absence of anomalous light emission according to whether the measurement value of the time-difference measuring unit 107 is 0. In this embodiment, presence or absence of anomalous light emission is judged based on the time difference measured by the time-difference measuring unit 107. However, it is also possible that a detection output of the optical sensor 106 is input to the CPU 113 and the CPU 113 judges presence or absence of anomalous light emission based on presence or absence of a detection output of the optical sensor 106. In this embodiment, it is judged that anomalous light emission is performed when the measurement value is not 0. However, it may be judged that anomalous light emission is performed when the measurement value is in a range (a value larger than 7600 and smaller than 8400) obtained by giving a slight margin of about 5% to a positive value (e.g. 8000) equivalent to a difference between time when the optical sensor 105 detects a light beam and time when the optical sensor 106 detects a light beam.

Details of the normal processing at step S3 in FIG. 6 are explained using FIG. 8. As shown in FIG. 8, in the phase adjustment processing for the writing clock PCLK, first, in the period D shown in FIG. 3, the CPU 113 sets the forced lighting signal to on to cause the LD 109 to perform forced light emission and sets a back-end synchronous lighting position (step S21). Subsequently, the time-difference measuring unit 107 measures a time difference between detection time of a leading-end synchronous detection signal from the optical sensor 105 and detection time of a back-end synchronous detection signal from the optical sensor 106 (step S22). The CPU 113 calculates a setting value (a writing clock setting value) of the frequency modulating unit 108-1 and a phase adjustment value in the phase modulating unit 108-2 in the writing clock generating unit 108 from a value of the time difference measured (step S23). The writing clock generating unit 108 carries out writing clock setting and phase adjustment according to the clock setting value and the phase adjustment value from the CPU 113 to adjust a frequency and a phase of the writing clock PCLK (step S24). This makes it possible to perform image magnification correction of the main scanning.

Details of the error processing at step S4 in FIG. 6 are explained with reference to FIG. 9. The error processing shown in FIG. 9 is stop control using existing jam stop processing. First, the CPU 113 judges whether jam (sheet jam) has occurred (step S31). When jam has not occurred ("No" at step S31), the CPU 113 returns to step S31 and performs the processing again. On the other hand, when jam has occurred ("Yes" at step S31), the CPU 113 stops an operation of the image forming unit and performs jam display on a display unit (not shown) of the image forming apparatus (step S32).

The CPU 113 judges whether a cover (a front door) has been opened (step S33). When the cover has not been opened ("No" at step S33), the CPU 113 returns to step S33 and performs the processing again. On the other hand, when the cover has been opened ("Yes" at step S33), the CPU 113 judges whether the jam has been eliminated (step S34). When the jam has not been eliminated ("No" at step S34), the CPU 113 returns to step S34 and performs the processing again. On the other hand, when the jam has been eliminated ("Yes" at step S34), the CPU 113 judges whether the cover has been closed (step S35). When the cover has not been closed ("No" at step S35), the CPU 113 returns to step S35 and performs the processing again. On the other hand, when the cover has been closed ("Yes" at step S35), the CPU 113 performs copy availability display on the display unit (not shown) of the image forming apparatus (step S36). When anomalous light emission of the LD 109 is detected, it is necessary to reset light emission of the LD 109 in the error processing. In the existing jam stop processing, a light emission operation of the LD 109 is reset according to opening and closing of the cover. In this embodiment, when the LD 109 abnormally emits light, the CPU 113 does not perform new error processing and sets the error status to jam occurrence at step S14 explained in FIG. 7 to make it possible to use the flow of the jam stop processing. At the time of anomalous light emission, the CPU 113 performs the jam stop processing to reset a light emission operation of the LD 109 according to opening and closing of the cover.

As described above, according to the first embodiment, the optical sensor 106 that generates a back-end synchronous detection signal is used to detect anomalous light emission when an operation for generating the back-end synchronous detection signal is not performed. Thus, an optical sensor exclusively used for detecting anomalous light emission is unnecessary. Therefore, it is possible to add an anomalous light emission detecting function to a color image forming apparatus having a magnification correction function simply by changing software. Since the jam stop processing is used as the error processing, only a small amount of change of software is required.

When anomalous light emission of the LD 109 at the time when an image signal is not input to the LD modulating unit 101 is detected, it is possible to prevent generation of an abnormal image due to anomalous light emission by executing the error processing such as reset of the LD modulating unit 101 and stop of the image forming apparatus.

Figure 10:
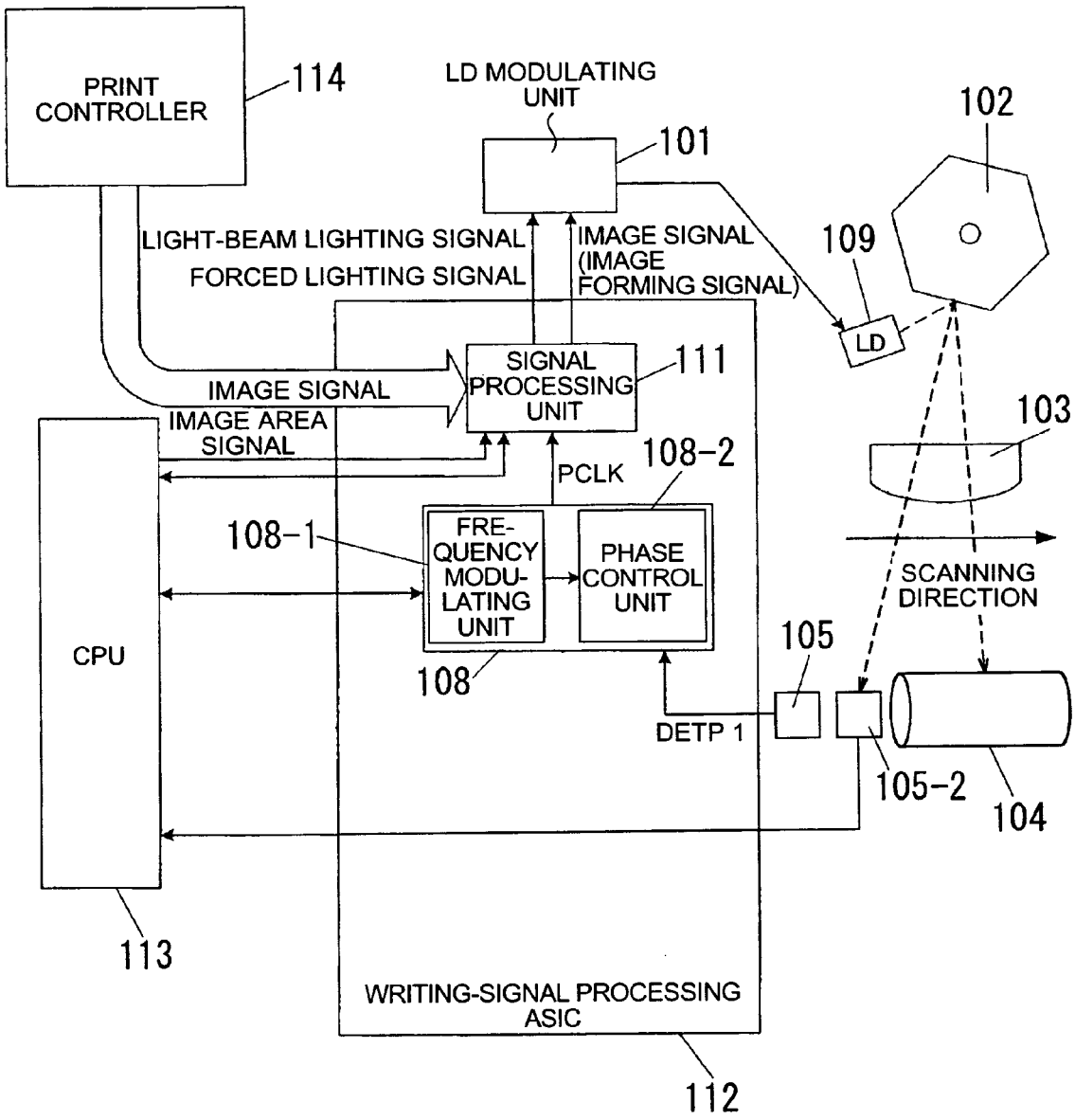
FIG. 10 is a block diagram of a structure of a writing unit according to a second embodiment of the present invention.

FIG. 10 is a block diagram of a structure of a writing unit according to a second embodiment of the present invention. In FIG. 10, components identical with or corresponding to those in FIG. 2 are denoted by the reference numerals and signs used in FIG. 2. In the writing unit according to this embodiment, the optical sensor 106, the time-difference measuring unit 107, and the magnification-correction control unit 110 are removed from the writing unit according to the first embodiment and an optical sensor 105-2 for detecting anomalous light emission is added.

The optical sensor 105-2 is arranged in a position where it is possible to detect a light beam emitted from the LD 109 in the period B in FIG. 3. Thus, there is no detection output if the LD 109 does not abnormally emit light. However, a detection output is generated when the LD 109 abnormally emits light. It is possible to judge presence or absence of anomalous light emission of the LD 109 according to presence or absence of a detection output of the optical sensor 105-2. In this embodiment, the writing unit has two modes: a mode for operating to immediately perform the error processing as in the first embodiment when anomalous light emission is detected and a mode for repeating an initialization operation of the LD modulating unit 101 a few times when anomalous light emission is detected and executing the error processing when the anomalous light emission is not eliminated by repeating the initialization operation. A user can select one of the two modes according to initial setting or the like. It is suitable to apply this embodiment to an apparatus in which superimposition of respective colors is unnecessary such as a monochrome image forming apparatus because the magnification correction function is not provided.

Figure 11:
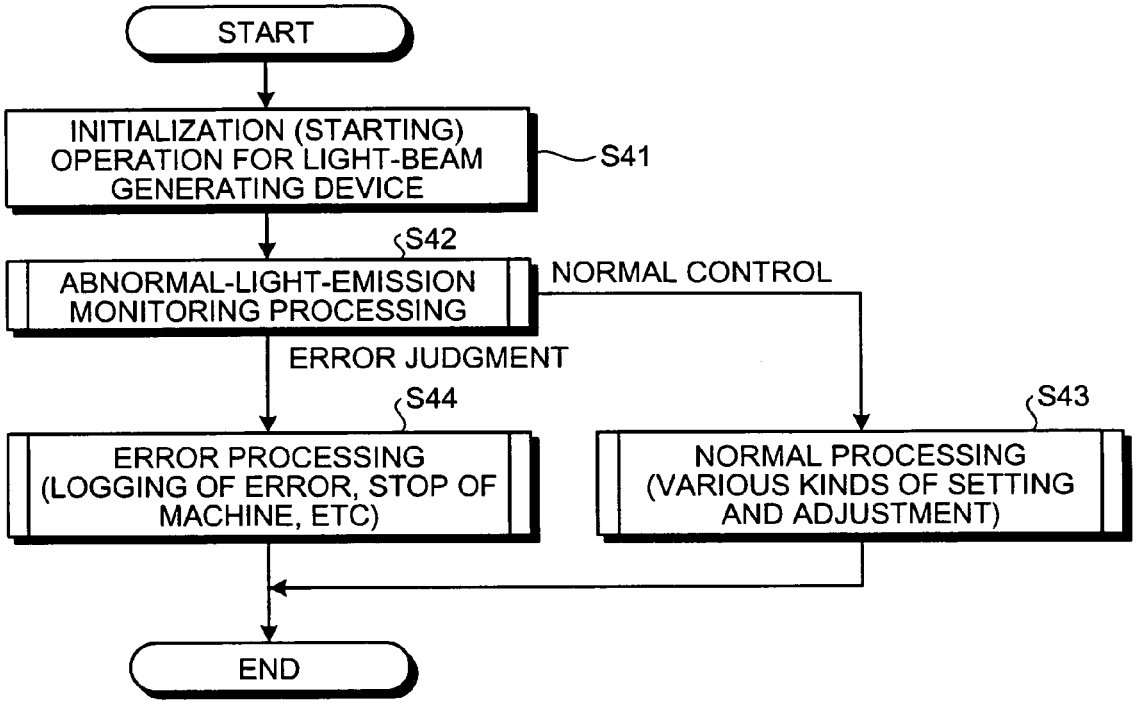
FIG. 11 is a flowchart of a flow from an initialization operation to error processing or normal processing through anomalous light emission monitoring.
Figure 12:
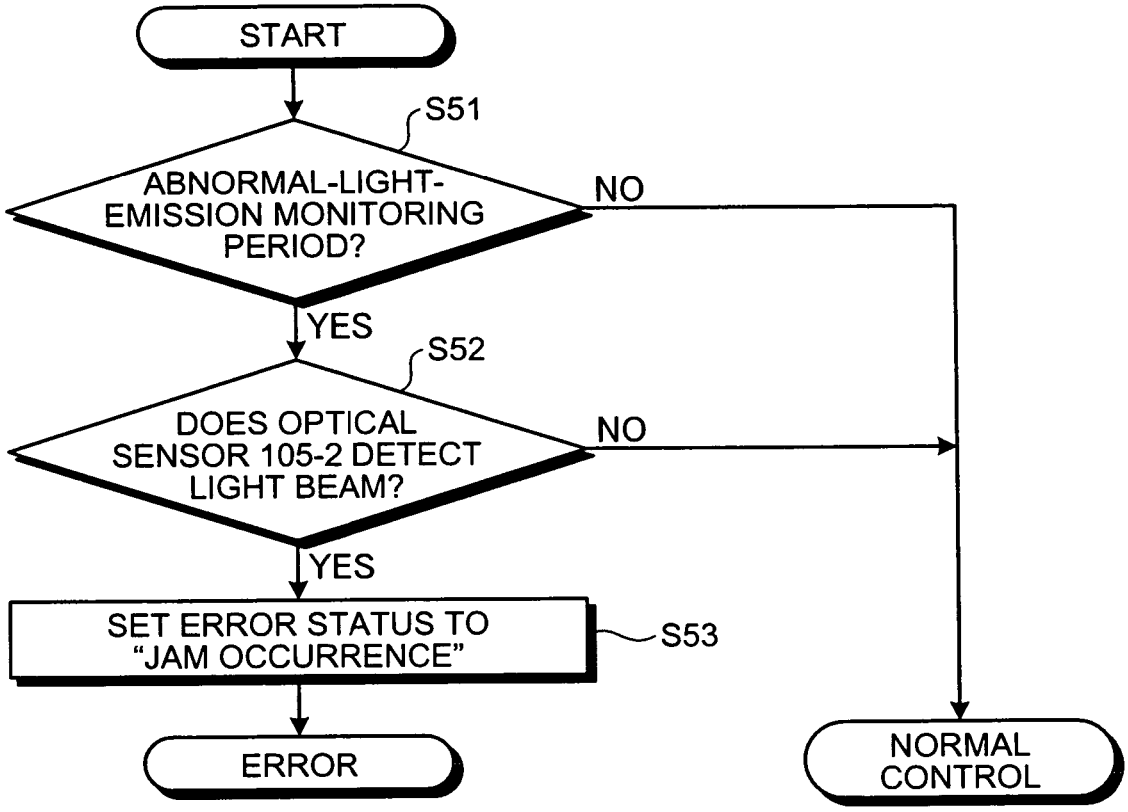
FIG. 12 is a flowchart of a flow of an example of anomalous-light-emission monitoring processing.
Figure 13:
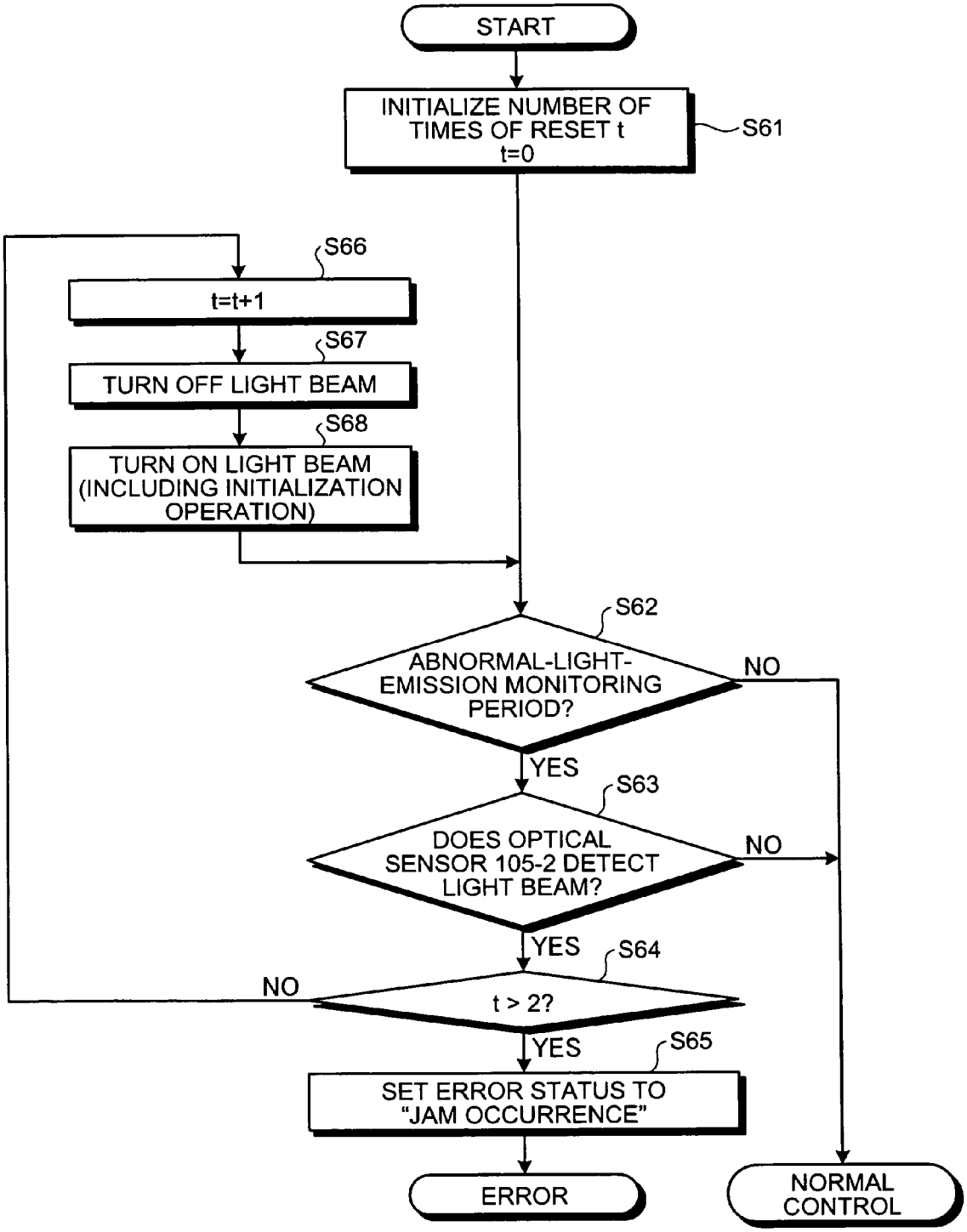
FIG. 13 is a flowchart of a flow of another example of the anomalous-light-emission monitoring processing.

Operations of the writing unit according to this embodiment having the structure described above are explained with reference to flowcharts in FIGS. 11 to 13. FIG. 11 is a flowchart of a flow from an initialization operation to error processing or normal processing through anomalous light emission monitoring. FIG. 12 is a flowchart of a flow of an example of anomalous-light-emission monitoring processing. FIG. 13 is a flowchart of a flow of another example of the anomalous-light-emission monitoring processing.

FIG. 11 corresponds to FIG. 6 in the first embodiment. Steps S41, S43, and S44 in FIG. 11 are the same as steps S1, S3, and S4 in FIG. 6, respectively. Thus, explanations of steps S41, S43, and S44 are omitted and step S42 is explained. Step S42 is processing for detecting anomalous light emission (anomalous-light-emission monitoring processing). Step S42 is set in the CPU 113 in advance to make it possible to selectively execute one of processing shown in FIG. 12 and processing shown in FIG. 13. An anomalous light emission monitoring period in this embodiment indicates the period B in FIG. 3.

In the anomalous-light-emission monitoring processing shown in FIG. 12, the CPU 113 judges whether a period is an anomalous light emission monitoring period (step S51). When a period is the anomalous light emission monitoring period ("Yes" at step S51), the CPU 113 judges whether the optical sensor 105-2 has detected a light beam (step S52). When the optical sensor 105-2 has detected a light beam ("Yes" at step S52), the CPU 113 sets an error status to "jam occurrence" (step S53). Consequently, when anomalous light emission is detected as in the first embodiment, jam stop processing described later is executed. Reset of a light emission operation of the LD 109 is performed in this jam stop processing. Back in FIG. 11, the CPU 113 performs error processing (step S44).

When a period is not the anomalous light emission monitoring period ("No" at step S51) or when a period is the anomalous light emission monitoring period but the optical sensor 105-2 has not detected a light beam ("No" at step S52), the CPU 113 judges that light emission is normal. Back in FIG. 11, the CPU 113 performs the normal processing (step S43). The anomalous-light-emission monitoring processing in FIGS. 12 and 13 is executed at a predetermined period (e.g., 500 microseconds) independent from a main scanning period (300 to 600 microseconds).

A principle of detection of anomalous light emission in the processing shown in FIG. 13 is the same as that in the processing shown in FIG. 12. Processing at steps S62 and 63 in FIG. 13 is the same as the processing at steps S51 and S52 in FIG. 12. Other kinds of processing are processing added for reset of the LD modulating unit 101.

In the following explanation, the user selects the mode for repeating the initialization operation for the LD modulating unit 101 a few times when anomalous light emission is detected and executing the error processing when the anomalous light emission is not eliminated by repeating the initialization operation. The user can set the number of times of reset t. In this embodiment, the number of times of reset t is set to two times and stored in a not-shown memory by the CPU 113.

Processing at the time when the user selects the mode for operating to immediately perform the error processing as in the first embodiment when anomalous light emission is detected is performed in the same manner as that in the first embodiment.

In the anomalous-light-emission monitoring processing shown in FIG. 13, the CPU 113 performs initialization of the number of times of reset t (sets the number of times to t=0) (step S61). Subsequently, as in the processing in FIG. 12, the CPU 113 performs monitoring of anomalous light emission (steps S62 and S63). When a period is the anomalous light emission monitoring period ("Yes" at step S62) and the optical sensor 105-2 has detected a light beam ("Yes" at step S63), the CPU 113 judges whether the number of times of reset t has exceeded two times (step S64). When the number of times of reset t has exceeded two times ("Yes" at step S64), the CPU 113 sets an error status to "jam occurrence" (step S65). Consequently, in the same manner as the processing in FIG. 12, when anomalous light emission is detected, jam stop processing described later is executed and reset of a light emission operation of the LD 109 is performed in this jam stop processing. Back in FIG. 11, the CPU 113 performs the error processing (step S44).

On the other hand, when the number of times of reset t has not exceeded two times, the CPU 113 increments the number of times of reset t by one (step S66), controls the LD modulating unit 101 to turn off the LD 109 (step S67), performs the same initialization operation as step S41 in FIG. 11 (step S68), and returns to step S62. In the processing in FIG. 13, when anomalous light emission is detected, the CPU 113 resets the LD modulating unit 101 to perform the initialization operation again, repeats the operation for detecting anomalous light emission, and performs the error processing when anomalous light emission is detected three times in a row.

As described above, according to this embodiment, the CPU 113 resets and initializes the LD modulating unit 101 rather than immediately performing stop control when anomalous light emission is detected. Thus, it is possible to automatically restore the LD modulating unit 101 to a normal operation. It is also possible to apply this embodiment to an image forming apparatus not having the magnification correction function.

Figure 14:
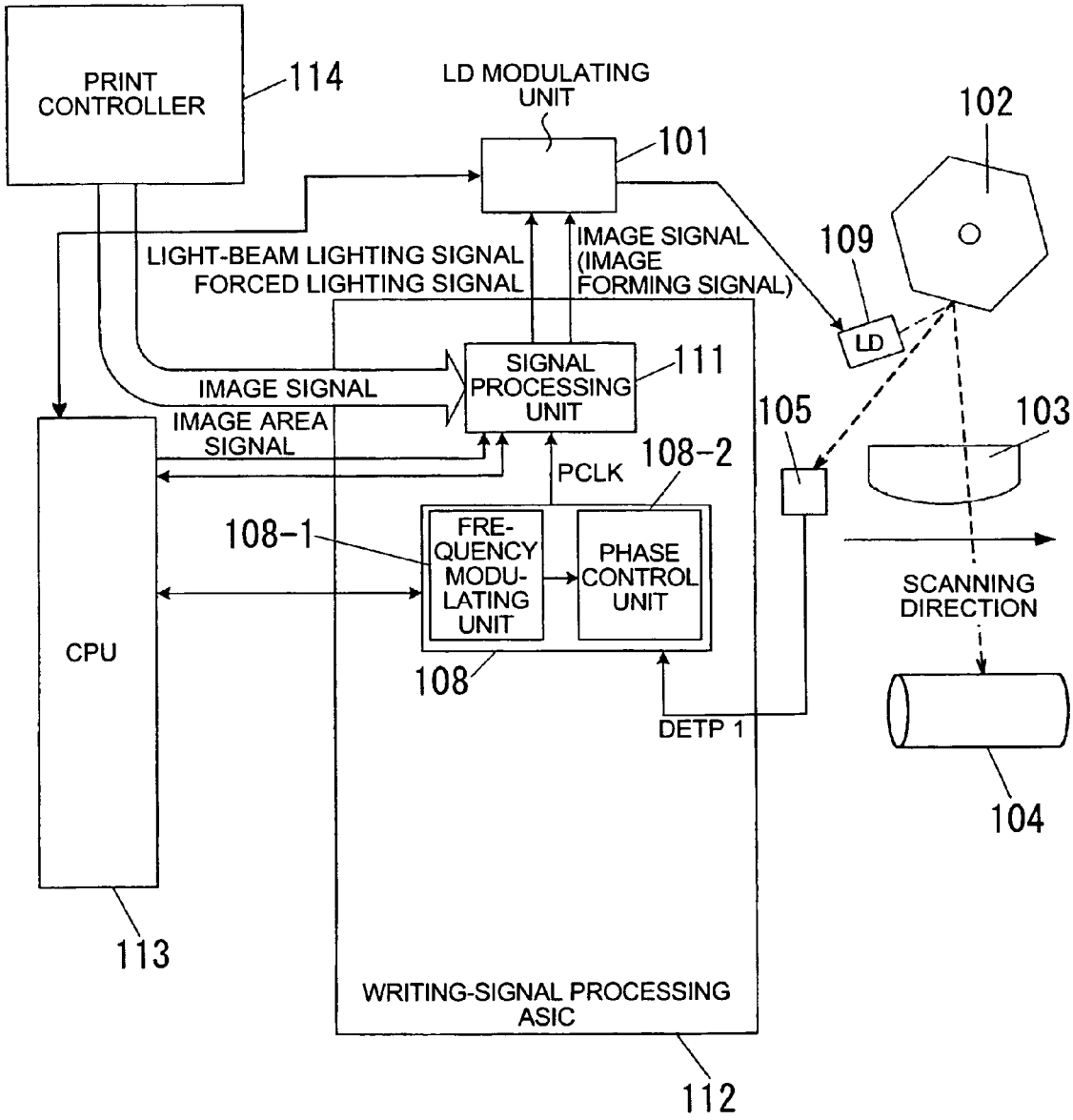
FIG. 14 is a block diagram of a structure of a writing unit according to a third embodiment of the present invention.

FIG. 14 is a block diagram of a structure of a writing unit according to a third embodiment of the present invention. In FIG. 14, components identical with or corresponding to those in FIG. 10 are denoted by the reference numerals and signs used in FIG. 10. In the writing unit according to this embodiment, the optical sensor 105-2 is removed from the writing unit according to the second embodiment and the optical sensor 105 is arranged in a position where it is possible to detect a light beam not transmitted through the fθ lens 103. Since a leading-end synchronous detection signal is generated by the light beam not transmitted through the fθ lens 103, it is unnecessary to perform a magnification correction operation. Thus, the optical sensor 106 for detecting a back-end synchronous detection signal, the time-difference detecting unit 107, and the magnification correcting unit 108 are also unnecessary.

Figure 15:
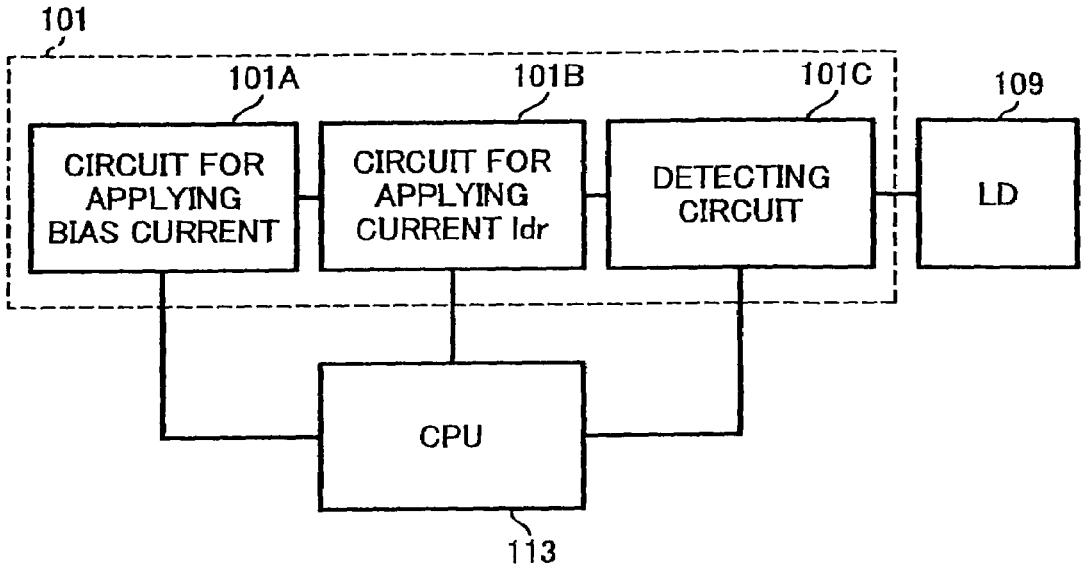
FIG. 15 is a diagram of a structure of an LD modulating unit.
Figure 16:
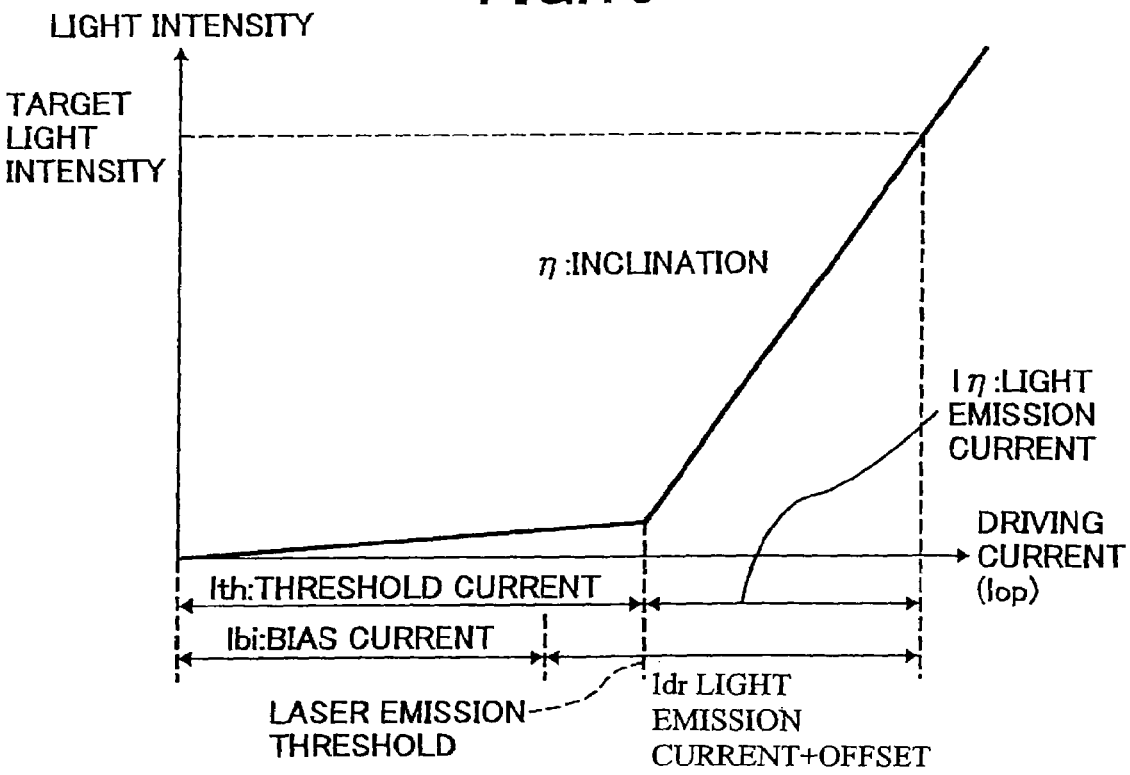
FIG.16 RELATED ART
FIG. 16 is a graph of a driving-current/laser-beam-output characteristic of a laser diode.

In this embodiment, detection of anomalous light emission of the LD 109 is not performed based on an output of an optical sensor as in the first or the second embodiment. The detection is performed based on a level of a current value of a driving current of the LD 109 in the LD modulating unit 101. FIG. 15 is a diagram of a structure of an LD modulating unit. As shown in FIG. 15, the LD modulating unit 101 includes a circuit 101A that feeds the bias current Ibi to the LD 109, a circuit 101B that feeds the current Idr (light emission current Iη+offset amount) to the LD 109, and a detection circuit 101C that detects a sum of the currents. The CPU 113 monitors a detection current of the detection circuit 101C. When an electric current exceeding the threshold current Ith is detected in a non-forced lighting period such as the period B in FIG. 3 in which an image formation signal is at a low level, the CPU 113 judges that anomalous light emission due to setting of the excessively large bias current Ibi has occurred.

As described above, in the writing unit according to this embodiment, since anomalous light emission is detected based on a level of a driving current of the LD 109, an optical sensor for detecting anomalous light emission is unnecessary. Since a leading-end synchronous signal is detected according to a light beam not transmitted through the fθ lens 103, a magnification correction operation is unnecessary.

In FIG. 15, the circuit 101A that feeds the bias current Ibi to the LD 109 and the circuit 101B that feeds the electric current Idr to the LD 109 are connected in series. However, these circuits may be connected in parallel. Instead of using a light beam not transmitted through the fθ lens 103, a light beam transmitted through a position where lens power is 0 of the fθ lens 103 (light is transmitted without being refracted) may be used.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus, comprising:

a light-beam generating unit that emits a light beam;

a light-emission control unit that controls an emission of the light beam of the light-beam generating unit based on an input image signal and performs a setting indicating to the light-beam generating unit whether to perform a forced light emission to detect a scanning timing;

a light-beam scanning unit that deflects the light beam emitted from the light-beam generating unit in a main scanning direction and irradiates the deflected light beam on an image carrier;

a developing unit that develops a latent image formed by the light beam on the image carrier to produce a visible image;

a transferring unit that transfers the visible image to a transfer member;

at least two optical sensors arranged at positions to receive the light beam deflected by the light-beam scanning unit, wherein one of the optical sensors is an anomalous-light emission detecting unit that detects an anomalous light emission of the light-beam generating unit when the light-emission control unit sets the light-beam generating unit to prevent the forced light emission of the light beam and does not detect the anomalous light emission when the light-emission control unit sets the light-beam generating unit to allow the forced light emission of the light beam; and a control unit that performs an error processing based on the detected anomalous light emission.

2. The image forming apparatus according to claim 1, wherein the error processing includes a reset of the light-emission control unit.

3. The image forming apparatus according to claim 1, wherein the error processing includes an operation halt of the image forming apparatus.

4. The image forming apparatus according to claim 3, wherein the operation halt is an operation halt of the image forming apparatus when a jamming occurs.

5. The image forming apparatus according to claim 1, wherein the one of the optical sensors that is the anomalous-light emission detecting unit is arranged at a forced light emission position to detect the scanning timing, and the control unit adopts a detection output detected by the one of the optical sensors when the light-beam generating unit is set to perform the forced light emission, as a detection signal to detect the scanning timing, and adopts a detection output detected by the one of the optical sensors when the light-beam generating unit is set not to perform the forced light emission, as a detection signal to detect the anomalous light emission.

6. The image forming apparatus according to claim 1, wherein the one of the optical sensors that is the anomalous-light emission detecting unit is arranged at a position excluding a forced light emission position to detect the scanning timing on a main scanning line and an effective image forming area.

7. The image forming apparatus according to claim 6, wherein the one of the optical sensors is arranged between the forced light emission position to detect the scanning timing and the effective image forming area.

8. The image forming apparatus according to claim 1, wherein the light-emission control unit causes the light-beam generating unit to emit the light beam using a driving current obtained by adding a bias current, which is equal to or smaller than a light-emission threshold current determined in advance, and a light emission current corresponding to an amplitude of the image signal, and the anomalous-light emission detecting unit detects the anomalous light emission of the light-beam generating unit when the driving current without an input of the image signal exceeds the light-emission threshold current.

9. The image forming apparatus according to claim 1, wherein the control unit starts an operation of detecting the anomalous light emission by the anomalous-light emission detecting unit after an initialization operation by the light-emission control unit to cause the light-beam generating unit to emit the light beam to set a threshold current is completed.

10. The image forming apparatus according to claim 1, further comprising:

a lens that modifies the deflected light beam before the deflected light beam is irradiated on the image carrier, wherein the one of the optical sensors that is the anomalous-light emission detecting unit is an arranged at the position to detect the deflected light beam that has passed through the lens without irradiating the image carrier.

11. An abnormality detecting method, comprising:

emitting including a light-beam generating unit emitting a light beam;

controlling including a light-emission control unit controlling an emission of the light beam of the light-beam generating unit based on an input image signal;

performing a setting by the light-emission control unit to indicate to the light-beam generating unit whether to perform a forced light emission to detect a scanning timing;

scanning including a light-beam scanning unit deflecting the light beam emitted from the light-beam generating unit in a main scanning direction and irradiating the deflected light beam on an image carrier;

developing including a developing unit developing a latent image formed by the light beam on the image carrier to produce a visible image;

transferring including a transferring unit transferring the visible image to a transfer member;

positioning at least two optical sensors to receive the deflected light beam;

detecting including one of the optical sensors that is an anomalous-light emission detecting unit detecting an anomalous light emission of the light-beam generating unit when the light-emission control unit sets the light-beam generating unit to prevent the forced light emission of the light beam and does not detect the anomalous light emission when the light-emission control unit sets the light-beam generating unit to allow the forced light emission of the light beam; and controlling including a control unit performing an error processing based on the detected anomalous light emission.

12. The abnormality detecting method according to claim 11, further comprising:

magnifying the deflected light beam with a lens before the deflected light beam is irradiated on the image carrier, wherein the one of the optical sensors that is the anomalous-light emission detecting unit is an arranged at the position to detect the deflected light beam that has passed through the lens without irradiating the image carrier.

13. The abnormality detecting method according to claim 11, wherein the positioning includes arranging the one of the optical sensors that is the anomalous-light emission detecting unit at a forced light emission position to detect the scanning timing, and the controlling includes the control unit adopting a detection output detected by the one of the optical sensors when the light-beam generating unit is set to perform the forced light emission, as a detection signal to detect the scanning timing, and adopting a detection output detected by the one of the optical sensors when the light-beam generating unit is set not to perform the forced light emission, as a detection signal to detect the anomalous light emission.

14. The abnormality detecting method according to claim 11, wherein the positioning includes arranging the one of the optical sensors that is the anomalous-light emission detecting unit at a position between a forced light emission position to detect the scanning timing on a main scanning line and an effective image forming area.

15. An image forming apparatus, comprising:

light-beam generating means for emitting a light beam;

light-emission control means for controlling an emission of the light beam of the light-beam generating means based on an input image signal and performing a setting to indicate to the light-beam generating means whether to perform a forced light emission to detect a scanning timing;

light-beam scanning means for deflecting the light beam emitted from the light-beam generating means in a main scanning direction and irradiating the deflected light beam on an image carrier;

developing means for developing a latent image formed by the light beam on the image carrier to produce a visible image;

transferring means for transferring the visible image to a transfer member;

optical sensing means for receiving the light beam deflected by the light-beam scanning means, wherein the optical sensing means includes an optical sensor that is anomalous-light emission detecting means for detecting an anomalous light emission of the light-beam generating means when the light-emission control means sets the light-beam generating means to prevent the forced light emission of the light beam and does not detect the anomalous light emission when the light-emission control means sets the light-beam generating means to allow the forced light emission of the light beam; and control means for performing an error processing based on the detected anomalous light emission.

16. The image forming apparatus according to claim 15, further comprising:

magnification means for modifying the deflected light beam before the deflected light beam is irradiated on the image carrier, wherein the one optical sensor that is the anomalous-light emission detecting means is an arranged at a position to detect the deflected light beam that has passed through the lens without irradiating the image carrier.

17. The image forming apparatus according to claim 15, wherein the optical sensor that is the anomalous-light emission detecting means is arranged at a forced light emission position to detect the scanning timing, and the control means adopts a detection output detected by the optical sensor when the light-beam generating means is set to perform the forced light emission, as a detection signal to detect the scanning timing, and adopts a detection output detected by the optical sensor when the light-beam generating means is set not to perform the forced light emission, as a detection signal to detect the anomalous light emission.

18. The image forming apparatus according to claim 15, wherein the optical sensor that is the anomalous-light emission detecting means is arranged at a position between a forced light emission position to detect the scanning timing on a main scanning line and an effective image forming area.

* * * * *